US010002693B2

(12) United States Patent
Karciauskas

(10) Patent No.: US 10,002,693 B2
(45) Date of Patent: Jun. 19, 2018

(54) HIGH-POWER COMPACT ELECTRICAL RESISTOR

(71) Applicant: VISHAY MCB INDUSTRIE, Chateau-Gontier (FR)

(72) Inventor: Pierre Karciauskas, Chateau Gontier (FR)

(73) Assignee: VISHAY MCB INDUSTRIE, Chateau-Gontier (FR)

( * ) Notice: Subject to any disclaimer, the term of this patent is extended or adjusted under 35 U.S.C. 154(b) by 0 days. days.

(21) Appl. No.: 15/111,900

(22) PCT Filed: Jan. 13, 2015

(86) PCT No.: PCT/EP2015/050497

§ 371 (c)(1),
(2) Date: Jul. 15, 2016

(87) PCT Pub. No.: WO2015/107047

PCT Pub. Date: Jul. 23, 2015

(65) Prior Publication Data

US 2016/0336098 A1 Nov. 17, 2016

(30) Foreign Application Priority Data

Jan. 16, 2014 (EP) ..... 14305060

(51) Int. Cl.
*H01C 1/082* (2006.01)
*H01C 1/024* (2006.01)
(Continued)

(52) U.S. Cl.
CPC ..... *H01C 1/082* (2013.01); *H01C 1/024* (2013.01); *H01C 3/00* (2013.01); *H01C 3/14* (2013.01)

(58) Field of Classification Search
CPC ..... H01C 3/00; H01C 1/024; H01C 1/082; H01C 3/14
(Continued)

(56) References Cited

U.S. PATENT DOCUMENTS 3,156,889 A * 11/1964 Starner ..... H01C 10/24 338/151
3,858,146 A * 12/1974 Simonsen ..... H01C 1/082 29/610.1
(Continued)

FOREIGN PATENT DOCUMENTS

DE 687 083 C 1/1940
DE 687083 * 1/1940 ..... H01C 1/082
(Continued)

OTHER PUBLICATIONS

International Search Report, dated Apr. 23, 2015, from corresponding PCT application.
(Continued)

*Primary Examiner* — Kyung Lee
*Assistant Examiner* — Iman Malakooti
(74) *Attorney, Agent, or Firm* — Young & Thompson

(57) ABSTRACT

The electrical resistance (10) includes a sealed housing (12) with a generally cylindrical shape defined along a longitudinal axis (X), a resistive element (16), extending along a spiral defined around the longitudinal axis (X), and a fluid guiding element (18), defining, with the sealed housing (12), a conduit for guiding a flow of fluid in contact with the resistive element (16). The guiding element (18) has a spiral shape defined around the longitudinal axis (X).

16 Claims, 3 Drawing Sheets

(51) Int. Cl.
*H01C 3/00* (2006.01)
*H01C 3/14* (2006.01)

(58) Field of Classification Search
USPC ..... 338/55
See application file for complete search history.

(56) References Cited

U.S. PATENT DOCUMENTS 4,420,739 A * 12/1983 Herren ..... F28D 9/0043 257/E23.098
4,434,417 A * 2/1984 Beriger ..... H01C 1/082 338/53
5,508,677 A 4/1996 Neubert et al.

FOREIGN PATENT DOCUMENTS

| | | | | | |
|---|---|---|---|---|---|
| DE | 29 47 997 | A1 | | 7/1981 | |
| DE | 2947997 | | * | 7/1981 | ..... H01C 1/082 |
| FR | 885 643 | A | | 9/1943 | |
| GB | 157 104 | A | | 12/1921 | |
| GB | 635 719 | A | | 4/1950 | |
| JP | H10 199701 | A | | 7/1998 | |
| WO | 2013/163994 | A1 | | 11/2013 | |

OTHER PUBLICATIONS

EP Search Report, dated May 27, 2014, from corresponding EP application.

* cited by examiner

HIGH-POWER COMPACT ELECTRICAL RESISTOR

The present invention relates to an electrical resistance.

It is known, in the state of the art, that the power of an electrical resistance in particular depends on its dimensions. More particularly, a high-power electrical resistance generally has relatively large dimensions.

The invention in particular aims to resolve this drawback, by proposing a compact electrical resistance having a high power per unit of volume.

To that end, the invention in particular relates to an electrical resistance, characterized in that it includes:

- a sealed housing, having an inner wall generally elongated along a longitudinal axis,
- at least one resistive element, extending along a spiral defined around the longitudinal axis,
- at least one guiding element for a low-conductivity coolant fluid, said guiding element defining, with the sealed housing, a conduit for guiding a flow of fluid in contact with the resistive element, said guiding element having a spiral shape defined around the longitudinal axis.

It should be noted that arranging a resistive element in a spiral makes it possible to have a long resistive element in a resistance with a limited length.

Furthermore, so as to be able to have a high-power electrical resistance, the invention provides for optimized cooling of the resistive element.

Indeed, the spiral guiding element makes it possible to guide a coolant flow effectively over the entire length of the resistive element, optimizing the interaction between the resistive element and the coolant flow It should be noted that such a structure makes it possible to produce a resistance having a low inductance.

It also appears that such a resistance has safer behavior in case of overload. Indeed, in case of excessive power, the resistive element is able to turn itself off instantaneously, such that the power then drops to zero, the fluid providing electrical insulation between the turned off ends of the resistive element.

Such a resistance is particularly suitable for ohmic values below 10Ω.

It should lastly be noted that the structure of the electrical resistance according to the invention allows an easy assembly of resistances.

For example, several resistances as defined above may easily be assembled in series. In particular, when each electrical resistance includes two end plates between which the housing extends, each end plate may be shared by two adjacent resistances.

It is also possible to assemble resistive elements in parallel, one, as previously described, being arranged inside the housing, and the other being arranged outside the housing, extending in a spiral around that housing.

Thus, the resistance structure according to the invention is modular, which simplifies the production of high-power electrical assemblies, for example thyristor converters.

An electrical resistance according to the invention may further include one or more of the following features, considered alone or according to all technically possible combinations.

- The electrical resistance includes two end plates, such that: —the housing extends along the longitudinal axis between the end plates, this housing being sealably fastened to each of these end plates, —each end plate includes an opening, for an electrical connection element connected to the resistive element, and—each end plate includes at least one through opening in fluid communication with the guide conduit.
- The electrical resistance includes a central tube arranged in the housing coaxially to said housing, the guiding element extending radially from said central tube to an inner surface of the housing.
- The resistive element is separate from the guiding element, said resistive element being housed in the guide conduit.
- The resistive element extends in a spiral around a line, said line extending in a spiral around the longitudinal axis.
- The resistive element is wired, and includes one wire or several parallel wires.
- The resistive element is a tape.
- The tape extends in a spiral around a line, said line for example extending in a spiral around the longitudinal axis, said spiral defined around the line being flat so as to have an oblong or ovoid cross-section.
- The resistive element is formed by the guiding element.
- The electrical resistance includes two metal connecting elements, with a generally cylindrical shape, such that: each end of the resistive element is connected to a respective one of the connecting elements, for example by welding or brazing, and each connecting element is hollow, and has at least one through orifice producing fluid communication between the inside of the connecting element and the guiding conduit.
- The electrical resistance includes means for circulating a fluid, in fluid communication with the guiding conduit, for circulating the fluid in the guiding conduit, in particular deionized water.
- The housing has a generally cylindrical shape with a circular, oblong or ovoid cross-section.

The invention will be better understood upon reading the following description, provided solely as an example and done in reference to the appended figures, in which:

FIG. 1 shows an electrical resistance 10 according to a first example embodiment of the invention.

Figure 1:
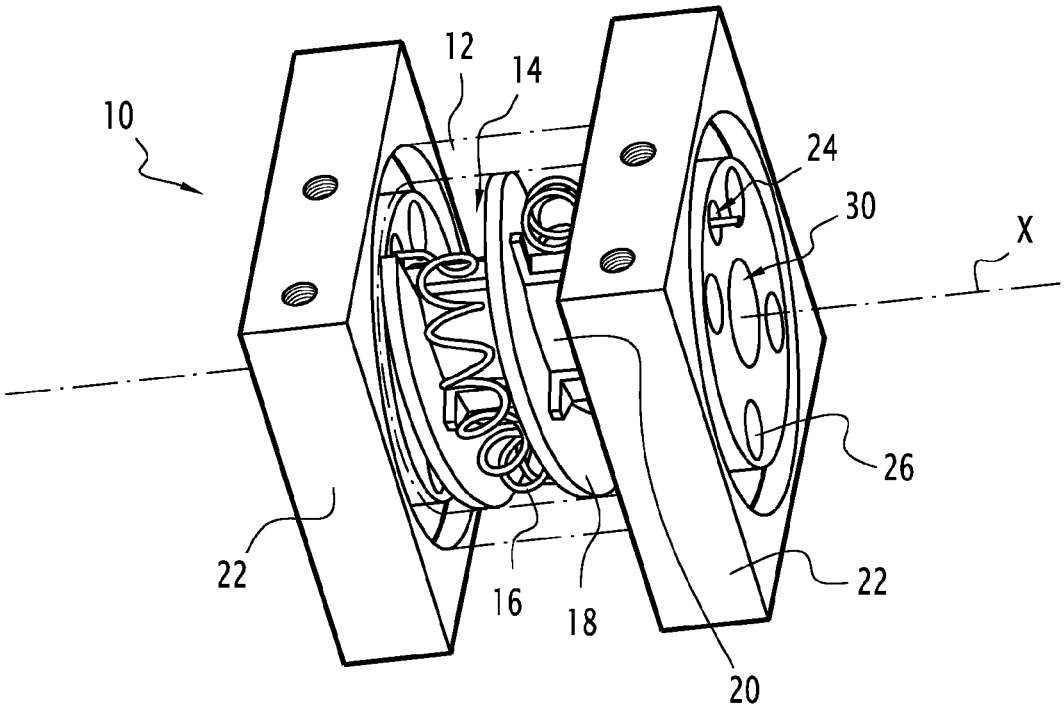
FIG. 1 is a perspective view of an electrical resistance according to a first example embodiment of the invention.

The electrical resistance 10 includes a sealed and insulating housing 12, in particular having an inner wall with a generally elongated shape along a longitudinal axis X. Said cylindrical housing 12, shown by transparency in FIG. 1, defines an inner space 14.

In the illustrated example, the housing 12 has a generally cylindrical shape with a circular cross-section. Alternatively, said section could be oblong or ovoid.

It should be noted that the housing 12 has inner and outer walls that may or may not be smooth, and that may or may not be parallel to one another.

The electrical resistance 10 further includes at least one resistive element 16 housed in said inner space 14. This resistive element 16 extends along a spiral defined around the longitudinal axis X.

According to this first example embodiment, the resistive element 16 is wired. For example, the resistive element 16 is formed by a single wire, or by several parallel wires.

Advantageously, this resistive element 16 extends in a spiral around a line, said line extending in a spiral around the longitudinal axis X. Thus, the resistive element 16 has an optimal length, while extending over a reduced dimension along the longitudinal axis X.

Advantageously, the resistive element 16 is made from a resistive metal, in particular a Ni—Cr alloy (80/20).

The electrical resistance 10 further includes at least one element 18 for guiding a nonconductive coolant fluid, defining a fluid guiding conduit with the housing 12. The guiding element 18 has a spiral shape defined around the longitudinal axis X. Thus, the guiding conduit also extends in a spiral around the longitudinal axis X.

Said guiding conduit is intended to guide a fluid flow in contact with the resistive element 16. Thus, in the described embodiment, the resistive element 16 is separate from the guiding element 18, and it is housed in the guide conduit.

More particularly, the resistive element 16 extends along the guide conduit, along said line, parallel to the guide element 18. Thus, it should be noted that the guide element 18 also allows the mechanical maintenance of the resistive element 16, this resistive element 16 remaining arranged in a spiral in the guide conduit.

Preferably, the electrical resistance 10 includes a central tube 20, arranged in the housing 12 coaxially to that housing 12. Thus, the guiding element 18 extends radially from said central tube 20 to an inner surface of the housing 12. In other words, the guide conduit is defined by the central tube 20, the guiding element 18 and the housing 12.

The electrical resistance 10 further includes two end plates 22, extending substantially perpendicular to the longitudinal axis X, between which the housing 12 extends along the longitudinal axis X. More particularly, each end of the housing 12 in the direction of the longitudinal axis X is sealably fastened to an end plate 22. For example, a sealing gasket is arranged between each end plate 22 and the housing 12.

Each end plate 22 is for example made from at least one electrically insulating material, and/or at least one electrically conductive material.

Each plate 22 has any general shape. For example, each plate 22 has a generally parallelepiped shape with a square or rectangular cross-section, or alternatively a generally cylindrical shape with a circular, oblong or ovoid cross-section. According to another alternative, the different facing surfaces of each plate 22 may or may not be parallel to one another.

Each end plate 22 optionally includes an opening 24, which may or may not be a through opening, for electrical connecting elements electrically connected to the resistive element 16, thus making it possible to electrically connect the resistive element 16 to other electrical components of the circuit. Alternatively, any other electrical connection mode between the resistive element 16 and the plate 22 may be considered. For example, such an electrical connection can be done by welding, brazing, crimping, etc.

Furthermore, each end plate 22 includes at least one through opening 26 in fluid communication with the guide conduit, for example emerging in said guide conduit.

This through opening 26 is intended to be connected to fluid circulation means (not shown), for circulating fluid in the guide conduit. These fluid circulation means may be of any possible type, and for example include a fluid reservoir and a pump.

The coolant has a low conductivity, so as not to interfere with the passage of current in the resistive element 16. For example, the coolant is a deionized water, and optionally includes glycol.

Figure 2:
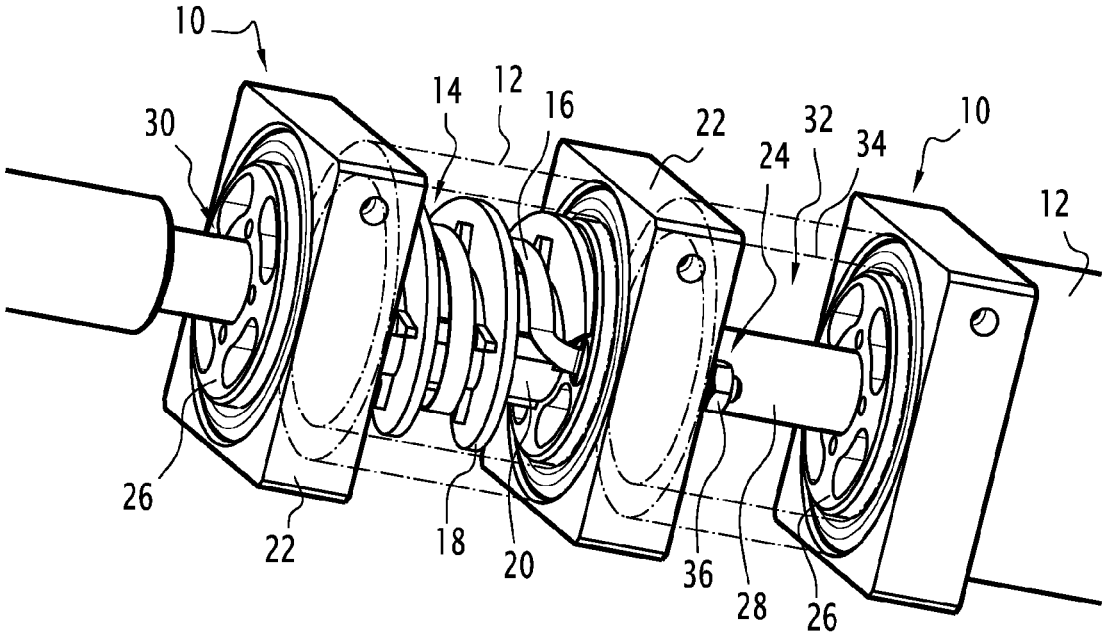
FIG. 2 is a perspective view of an electrical resistance according to a second example embodiment of the invention.

FIG. 2 shows an electrical resistance 10 according to a second example embodiment of the invention. In this figure, the elements similar to those of the preceding figure are designated using identical references.

More particularly, this FIG. 2 partially shows an assembly of electrical resistances 10. Indeed, it is possible to assemble a plurality of electrical resistances 10 in series.

To that end, a central rod 28 with axis X longitudinally crosses through each resistance 10, so as to connect them mechanically. In this case, each end plate 22 is provided with a passage opening 30 for said central rod 28, and the central tube 20 is hollow such that the central rod 28 passes longitudinally in this central tube 20, coaxially to this central tube 20. More particularly, each central rod 28 connects two consecutive plates 22.

Optionally, a space 32 is provided between two adjacent resistances 10, inside which electrical connection means (not shown) are preferably arranged between the resistive elements 16 of the two adjacent resistances 10. This base 32 therefore extends longitudinally between the end plate 22 of the two adjacent resistances. Furthermore, the space 32 is radially defined by another sealed housing 34, extending along the longitudinal axis X between these end plates 22 of these adjacent resistances. Thus, the coolant can circulate from one resistance 10 to the other by passing through this space 32.

According to one alternative, this space 32 is replaced by a resistance 10 of the type previously described, or a resistance of another type, for example, a resistance cooled by the fluid, comprising a heat-conducting ceramic tube and outwardly covered by a resistive element.

Furthermore, according to another alternative, the cylindrical housing 12 can itself form the support for another resistance, called outer resistance. In this case, this cylindrical housing 12 conducts heat (for example made from an alumina-type ceramic) and is covered with an outer resistive element. This outer resistance is then for example cooled by a fluid circulation on the inner face of the cylindrical housing 12. According to this alternative, one has two coaxial resistive elements, one being cooled directly by the fluid (as previously described), with a low ohmic value, and the other being arranged on the outer tube 12, being able to have a higher ohmic value, these two resistive elements being electrically insulated from one another.

It will be noted that such an assembly of resistances 10 may also be done with resistances 10 similar to that of the first example embodiment.

The resistance 10 of the second embodiment differs from the first in that its resistive element 16 is formed by a tape. This resistive element 16 in tape form extends in a spiral around the longitudinal axis X, between ends each connected to a respective connection element 36 supported by the corresponding end plate 22.

It appears that a tape has a larger heat exchange surface with the coolant than a wire having a circular section, such that the cooling of a resistance 10 according to this second embodiment is improved. Consequently, such a resistance 10 may have a power greater than that of a resistance according to the first embodiment.

Of example, it is possible to produce such a resistance 10 of 0.5Ω, measuring 25 mm along the longitudinal axis X and having a diameter of 40 mm, with an inductance below 100 nH. Such a resistance can dissipate more than 6 kW continuously, with a fluid flow rate circulating in the conduit of about 10 L/min.

It should be noted that the tape 16 may or may not have a smooth surface, may or may not have holes, may or may not include lugs or reliefs, and may have a cross-section that is constant or variable over its length.

Figure 3:
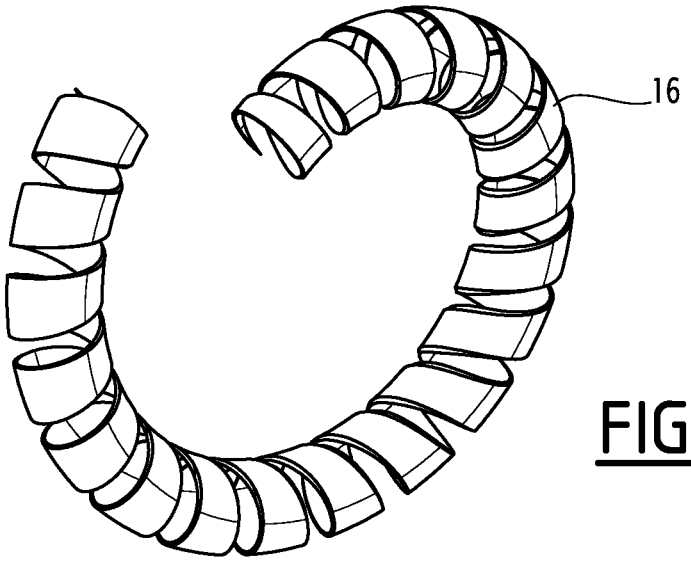
FIGS. 3 and 4 are partial perspective views of a resistive element according to two respective alternative embodiments, intended to equip the electrical resistance of FIG. 1 or FIG. 2.

According to one alternative shown in FIG. 3, the tape 16 could, like the wired resistive element of the first embodiment, extend in a spiral around a line, said line for example extending in a spiral around the longitudinal axis.

Figure 4:
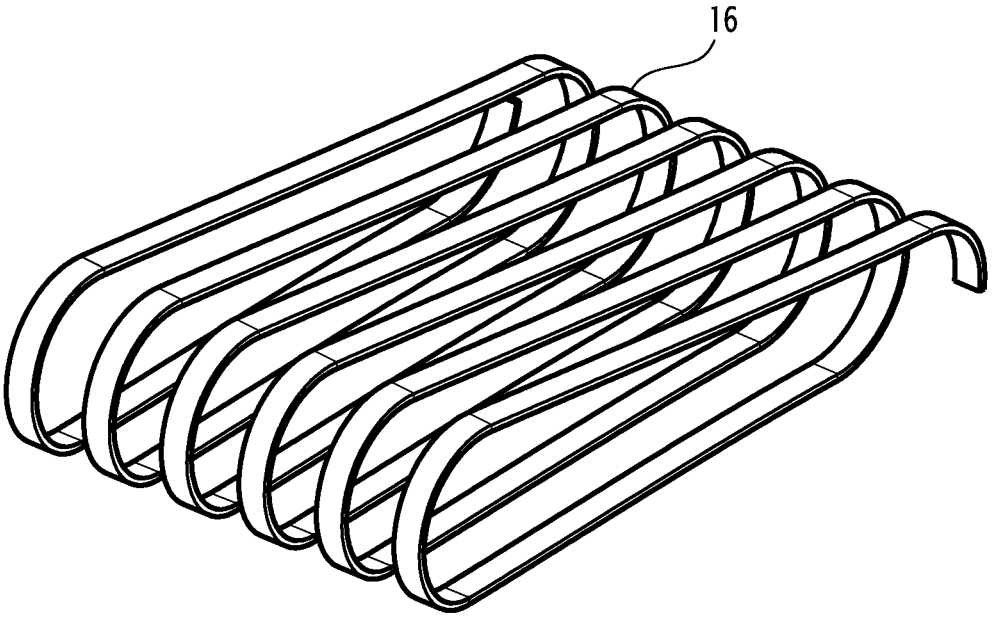

In the latter case, according to one alternative shown in FIG. 4, the spiral defined around the line is flat so as to have an oblong or ovoid cross-section. Thus, this cross-section has smaller dimensions relative to a circular section, which makes it possible to reduce the inductance of the resistive element 16. Alternatively, the spiral could have a cross-section with any other possible shape.

Figure 5:
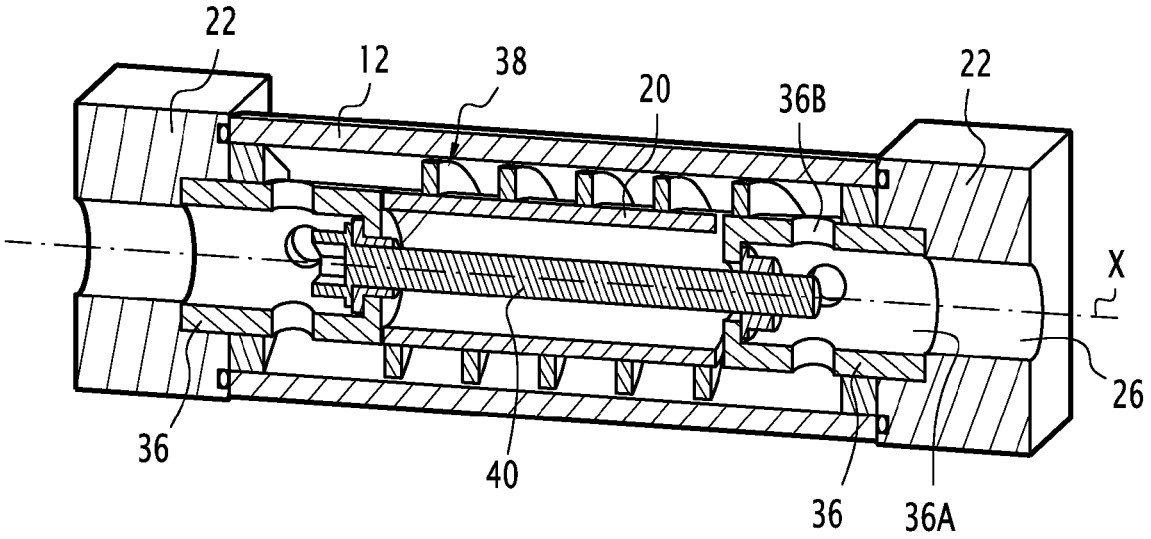
FIG. 5 is a perspective semi-view of an electrical resistance according to a third example embodiment of the invention.

FIG. 5 shows an electrical resistance 10 according to a third example embodiment of the invention. In this figure, the elements similar to those of the two preceding figures are designated using identical references.

According to this third embodiment, the electrical resistance 10 includes a resistive element 38 that also forms a guiding element.

In this case, this resistive element 38, which will be called resistive guide element 38 below, is in the form of a tape, extending in a spiral along the longitudinal axis X, and extending radially between the central tube 20 and the inner surface of the housing 12. Thus, the coolant being guided directly by the resistive guide element 38, it interacts optimally with that resistive guide element 38 to allow cooling thereof.

The resistive element 38 in tape form may or may not have smooth surfaces, and may have a cross-section that is constant or variable over its length.

In this example, the resistance 10 includes two connection elements 36, each arranged at one end of the central tube 20 in the direction of the longitudinal axis X, and each being partially housed in a respective one of the end plates 22.

Each connection element 36 has a generally cylindrical shape around the longitudinal axis X. Furthermore, each connection element 36 is hollow, and has a longitudinal opening 36A in fluid communication with the fluid passage opening 26 arranged in the corresponding end plate, as well as at least one side opening 36B emerging in the fluid circulation conduit. Thus, each connection element 36 forms a connection element of the fluid circulation means with the circulation conduit.

Furthermore, each connection element 36 is made from a conductive material, for example stainless steel, in order to form an electrical connection element with the resistive guiding element 38. Thus, each end of the resistive guiding element 38 is electrically connected to a respective one of the connection elements 36, for example by welding or brazing.

In the illustrated example, the connection elements 36 are secured to one another by a gripping rod 40, extending in the central tube 20, coaxially to said central tube 20. The central tube 20 is thus gripped between the connection elements 36 by this gripping rod 40.

The gripping rod 40 may be threaded (and thus form a screw) or not, may have a section that is constant or that varies over its length, and may be solid or hollow.

An electrical resistance according to this third example embodiment is particularly suitable for low ohmic values, in particular below 0.1Ω.

It should be noted that the invention is not limited to the embodiments previously described, but could assume various alternatives.

In particular, other resistance structures could be provided.

For example, it is possible to consider an assembly including at least two resistive elements in parallel. In this case, the assembly includes two coaxial resistances, in particular an inner resistance similar to one of those previously described, and an outer resistance that is also similar, the central tube of which is formed by the housing of the inner resistance.

It is also possible to consider an assembly of serial resistances similar to that of FIG. 2, the resistances of which are similar to that of FIG. 3.

The invention claimed is:

1. An electrical resistance, including:

a sealed housing, having an inner wall elongated along a longitudinal axis, at least one spiral resistive element, extending around the longitudinal axis, at least one guiding element for a low-conductivity coolant fluid, the guiding element defining, with the sealed housing, a guide conduit for guiding a flow of fluid in contact with the resistive element, the guiding element having a spiral shape defined around the longitudinal axis, the at least one resistive element being separate from the at least one guiding element, so that the at least one resistive element is housed in the guide conduit, an end plate at each end of the sealed housing, so that the at least one resistive element and the at least one guiding element extend away from the end plates inside the sealed housing, a through opening in each end plate, the through openings being configured for fluid circulation to the guide conduit.

2. The electrical resistance according to claim 1, including two end plates, such that:

the sealed housing extends along the longitudinal axis between the end plates, this sealed housing being sealably fastened to each of these end plates, each end plate includes an opening, for an electrical connection element connected to the resistive element, each end plate includes at least one through opening in fluid communication with the guide conduit.

3. The electrical resistance according to claim 1, including a central tube arranged in the sealed housing coaxially to said sealed housing, the guiding element extending radially from said central tube to an inner surface of the sealed housing.

4. The electrical resistance according to claim 1, wherein the resistive element is separate from the guiding element, said resistive element being housed in the guide conduit.

5. The electrical resistance according to claim 4, wherein the resistive element extends in a spiral around a line, said line extending in a spiral around the longitudinal axis.

6. The electrical resistance according to claim 4, wherein the resistive element is wired, and includes one wire.

7. The electrical resistance according to claim 4, wherein the resistive element is wired, and includes several parallel wires.

8. The electrical resistance according to claim 4, wherein the resistive element is a tape.

9. The electrical resistance according to claim 8, wherein the tape extends in a spiral around a line, said line extending in a spiral around the longitudinal axis, said spiral defined around the line being flat so as to have an oblong cross-section.

10. The electrical resistance according to claim 8, wherein the tape extends in a spiral around a line, said line extending in a spiral around the longitudinal axis, said spiral defined around the line being flat so as to have an ovoid cross-section.

11. The electrical resistance according to claim 1, wherein the resistive element is formed by the guiding element.

12. The electrical resistance according to claim 11, including two metal connection elements, each having a generally cylindrical shape, such that:

each end of the resistive element is connected to a respective one of the connecting elements, each connecting element is hollow, and has at least one through orifice producing fluid communication between the inside of the connecting element and the guide conduit.

13. The electrical resistance according to claim 1, including a circulating member for circulating a fluid, in fluid communication with the guide conduit, for circulating the fluid in the guide conduit.

14. The electrical resistance according to claim 1, wherein the sealed housing has a generally cylindrical shape with a circular section.

15. The electrical resistance according to claim 1, wherein the sealed housing has a generally cylindrical shape with a oblong cross-section.

16. The electrical resistance according to claim 1, wherein the sealed housing has a generally cylindrical shape with an ovoid cross-section.

* * * * *